US012352552B2

(12) United States Patent
Liebenberg et al.

(10) Patent No.: US 12,352,552 B2
(45) Date of Patent: Jul. 8, 2025

(54) WIRELESS INITIATING ARRANGEMENT

(71) Applicant: DETNET SOUTH AFRICA (PTY) LTD, Johannesburg (ZA)

(72) Inventors: Abraham Johannes Liebenberg, Johannesburg (ZA); Elmar Lennox Muller, Centurion (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 0 days.

(21) Appl. No.: 18/682,624

(22) PCT Filed: Jul. 7, 2022

(86) PCT No.: PCT/ZA2022/050028
§ 371 (c)(1),
(2) Date: Feb. 9, 2024

(87) PCT Pub. No.: WO2023/028620
PCT Pub. Date: Mar. 2, 2023

(65) Prior Publication Data

US 2024/0361114 A1 Oct. 31, 2024

(30) Foreign Application Priority Data

Aug. 24, 2021 (ZA) ..... 2021/06163

(51) Int. Cl.
*F42D 1/05* (2006.01)
*F42B 3/10* (2006.01)
(Continued)

(52) U.S. Cl.
CPC ..... *F42D 1/05* (2013.01); *F42B 3/10* (2013.01); *F42C 15/42* (2013.01); *F42D 1/02* (2013.01); *F42D 1/055* (2013.01); *F42D 3/04* (2013.01)

(58) Field of Classification Search
CPC ... F42D 1/02; F42D 1/045; F42D 1/05; F42D 1/055; F42D 3/00; F42D 3/04; F42B 3/00; F42B 3/10; F42C 15/42
(Continued)

(56) References Cited

U.S. PATENT DOCUMENTS 3,327,792 A 6/1967 Boop
5,263,416 A 11/1993 Amundson et al.
(Continued)

FOREIGN PATENT DOCUMENTS

CA 3215233 A1 * 3/2023 ..... F42B 3/10
WO 2012149277 A2 11/2012
(Continued)

OTHER PUBLICATIONS

International Preliminary Report on Patentability for Application No. PCT/ZA2022/050028 dated Feb. 15, 2023 (9 pages).
(Continued)

*Primary Examiner* — James S Bergin
(74) *Attorney, Agent, or Firm* — Michael Best & Friedrich LLP

(57) ABSTRACT

A wireless detonator initiating arrangement (10) which includes a first housing (20) which contains a receiver (24) and a signal processor (28), a second housing (36) which contains an explosive (38), a casing (52) which contains an initiator (16) which is responsive to the signal processor (28) to ignite the explosive (38) and a third housing (46) which contains a power source (50) to power the signal processor (28).

3 Claims, 2 Drawing Sheets

(51) Int. Cl.

| | |
|---|---|
| ***F42C 15/42*** | (2006.01) |
| ***F42D 1/02*** | (2006.01) |
| ***F42D 1/055*** | (2006.01) |
| ***F42D 3/04*** | (2006.01) |

(58) Field of Classification Search
USPC ..... 102/202.14, 206, 214, 217, 218
See application file for complete search history.

(56) References Cited

U.S. PATENT DOCUMENTS

| | | | | |
|---|---|---|---|---|
| 5,531,164 | A | 7/1996 | Mosley | |
| 9,709,373 | B2 * | 7/2017 | Hikone | F42D 1/045 |
| 11,874,098 | B2 * | 1/2024 | Muller | F42D 1/05 |
| 12,174,003 | B2 * | 12/2024 | Muller | F42D 5/00 |
| 2005/0178282 | A1 | 8/2005 | Brooks et al. | |
| 2010/0212480 | A1 | 8/2010 | Bell | |
| 2020/0300593 | A1 | 9/2020 | Sullivan et al. | |

FOREIGN PATENT DOCUMENTS

| | | | |
|---|---|---|---|
| WO | 2015199620 | A1 | 12/2015 |
| WO | 2021080513 | A1 | 4/2021 |

OTHER PUBLICATIONS

International Search Report and Written Opinion for Application No. PCT/ZA2022/050028 dated Oct. 10, 2022 (9 pages).

* cited by examiner

WIRELESS INITIATING ARRANGEMENT

CROSS REFERENCE TO RELATED APPLICATIONS

This application is a U.S. National Phase application of International Patent Application No. PCT/ZA2022/050028 filed Jul. 7, 2022 which claims priority to South Africa Patent Application ZA 2021/06163 filed Aug. 24, 2021, the entire contents of both of which are herein incorporated by reference.

BACKGROUND OF THE INVENTION

This invention relates to a wireless detonator initiating arrangement.

An arrangement of the aforementioned kind can be a bulky device. The arrangement requires a receiver which can receive electromagnetic command signals which travel, at times, through rock. An electrical supply is called for to power the receiver. Provision must be made for a processor to implement command signals relating to synchronisation and firing. An initiator, which may be in the form of a suitably configured detonator, is also required. Electrical energy is needed to ignite the initiator.

Certain applications also call for the initiating arrangement to be coupled in an effective manner to a booster which contains a secondary explosive.

To address the challenges relating to storage and transport a modular approach may be required so that hazardous components can be separated from non-hazardous components. This aspect mitigates against assembly of the initiating arrangement under factory conditions and, conversely, means that assembly on site by an operator, at a blast bench, should be readily effected in a safe and efficient way.

An object of the invention is to address the aforementioned requirement.

SUMMARY OF THE INVENTION

The invention provides a wireless detonator initiating arrangement which includes a first module comprising a first housing in which is mounted a signal processing assembly, a second module comprising a second housing which is engaged with the first housing and which contains an explosive material, and an initiator which is engageable with at least the first housing.

Preferably the initiator extends between the first housing and the second housing.

The initiator may include a first end which is located in a first recess in the first housing and a second end which is located in a second recess in the second housing.

A power supply may be mounted to the first housing.

In a variation of the invention the wireless detonator initiating arrangement includes a third housing which contains a power supply and which is engageable with the first housing or with the second housing thereby to connect the power supply to the signal processing assembly.

The signal processing assembly, responsive to a wireless fire command signal from a blast controller, is used to cause ignition of the initiator.

The signal processing assembly and the power supply can be in separate interengageable housings. An explosive (booster) can be in a separate housing exposed to the initiator which, optionally, is mounted inside a suitably-designed casing.

The wireless detonator initiating arrangement can be configured to be responsive to magnetic waves which are transmitted through rock to the signal processing assembly. Alternatively, the arrangement is configured to communicate with a top-box, located at a mouth of a borehole in which the arrangement is suspended. The top-box controls operation of the arrangement in response to wireless command signals from a blast controller.

BRIEF DESCRIPTION OF THE DRAWINGS

The invention is further described by way of example with reference to the accompanying drawings in which.

DESCRIPTION OF PREFERRED EMBODIMENT

Figure 1:
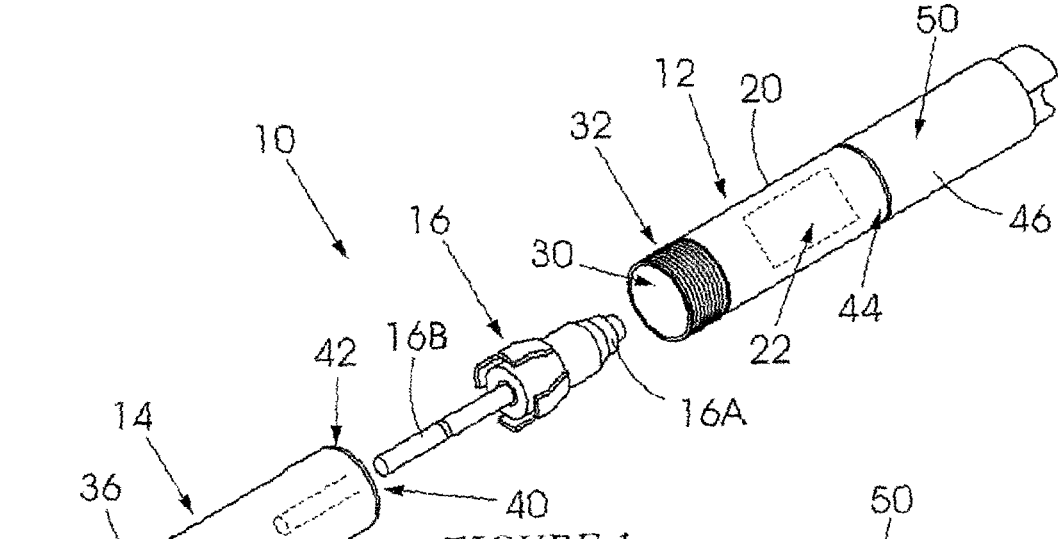
FIG. 1, FIG. 2 and FIG. 3 depict successive stages in the assembly of a wireless detonator initiating arrangement according to the invention.

FIG. 1 of the accompanying drawings depicts a wireless detonator initiating arrangement 10, according to the invention, in a disassembled configuration.

The arrangement 10 includes a first module 12, a second module 14 and an initiator 16.

Figure 4:
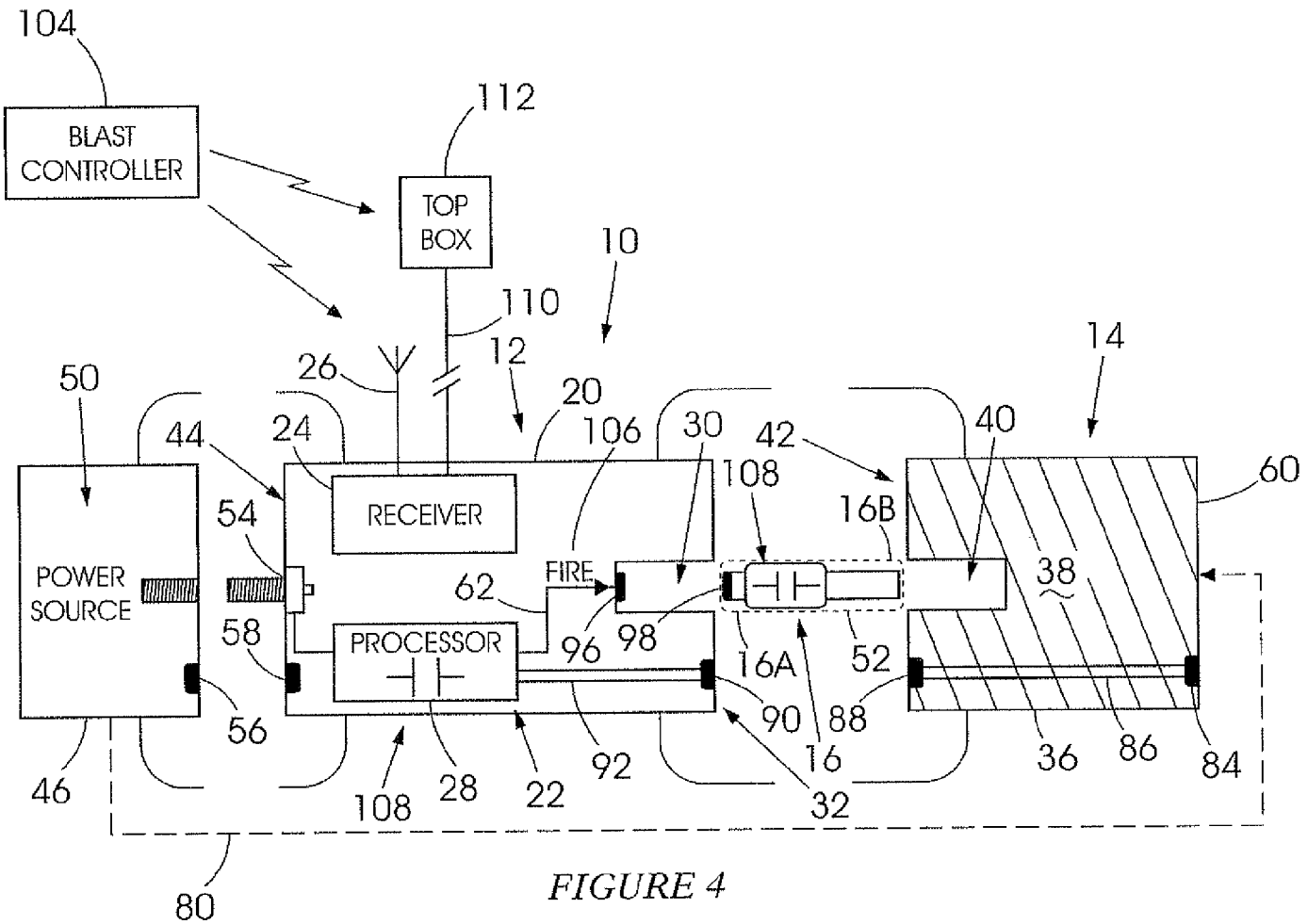
FIG. 4 is a block diagram representation showing components of the wireless detonator initiating arrangement of the invention.

Referring in addition to FIG. 4 the first module 12 comprises a first elongate tubular housing 20 in which is mounted a signal processing assembly 22. The assembly 22 includes an electromagnetic communication signal receiver 24 which is coupled to a receiving antenna 26 and a signal processor 28. The housing 20 has a first recess 30 concentrically positioned at an end 32.

The second module 14 comprises a second housing 36 which is of elongate tubular shape. The housing 36 contains a secondary explosive 38. The module 14 constitutes a booster.

The housing 36 has a second recess 40 which is concentrically positioned at an end 42 which faces the first recess 30.

An end 44 of the housing 20 which is remote from the recess 30 can be coupled when required to a third housing 46 which contains a power source 50 e.g. a battery.

The initiator 16 has a first end 16A and an opposed second end 16B.

The initiator 16 and the second module 14 which houses the explosive 38 are hazardous goods. If these components are not connected to the first module 12 nor to the third housing 46 then the first module 12 and the third housing are not regarded as hazardous goods and can be transported and stored without taking into account regulations which apply to hazardous goods. Optionally the initiator 16 is mounted inside a custom-designed casing 52, which is shown in dotted outline in FIG. 4.

In one form of the invention the third housing 46 is coupled to the first housing 20 under factory conditions. To achieve this use is made of a simple screw fitting to fix the third housing 46 to the first housing 20. A switch 54 mounted to the housing 20 is used to prevent the power source 50 from inadvertently energising the receiver 24 and the processor 28. Prior to installation and use at a blast bench the switch 54 is turned to an on position so that the power source 50 can energise the receiver 24 and the processor 28. When the housing 46 is coupled to the housing 20 electrical connections are made between contacts 56 connected to the power source 50 and contacts 58 connected to the processing assembly 22 but through the switch 54.

In another form of the invention the third housing 46, with the power source 50, is connected on site to the housing 36, on a side 60 remote from the initiator 16, as is shown by a dotted line 80. This can be done by means of a screw fitting, or a bayonet connection. The contacts 56 on the power source 50 are thereby connected to contacts 84 on the housing 36. A conductor 86, connected to the contacts 84, extends to additional contacts 88 on the housing 36. When the housing 36 is coupled to the housing 20 the contacts 88 are electrically connected to contacts 90 on the housing 20 and power is then available via a conductor 92 to operate the receiver 24 and the processor 28, which regulate firing of the initiator 16.

In one embodiment of the invention the third housing 46 with the power source 50 is supplied as a separate component which is connected to the first housing 20, only when required, on site. Use can be made of the switch 54 to prevent the application of electricity to the receiver and processor until required. The switch 54 could be electronically controlled in that it is only operable when a signal from an external source, such as a blast controller 104, is received by the receiver. Thereafter, the receiver 24 and the processor 28, using energy harvesting techniques which recover energy from a signal, from the blast controller 104, induced into coils (not shown) at the receiver 24, actuate the switch 54 and the power source 50 is then fully connected to the first module 12.

Figure 2:
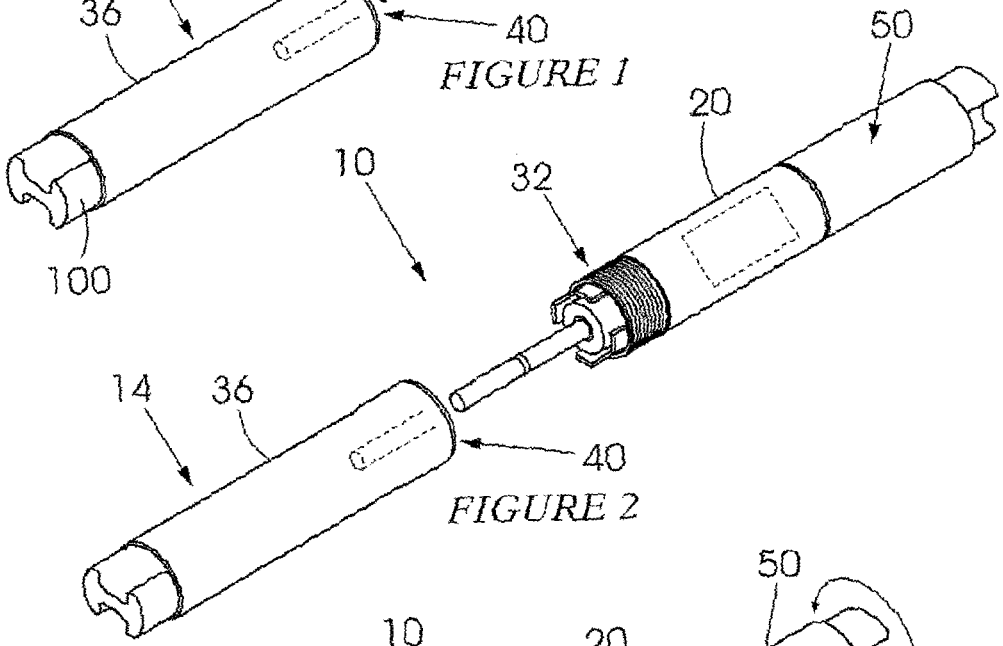
Figure 3:
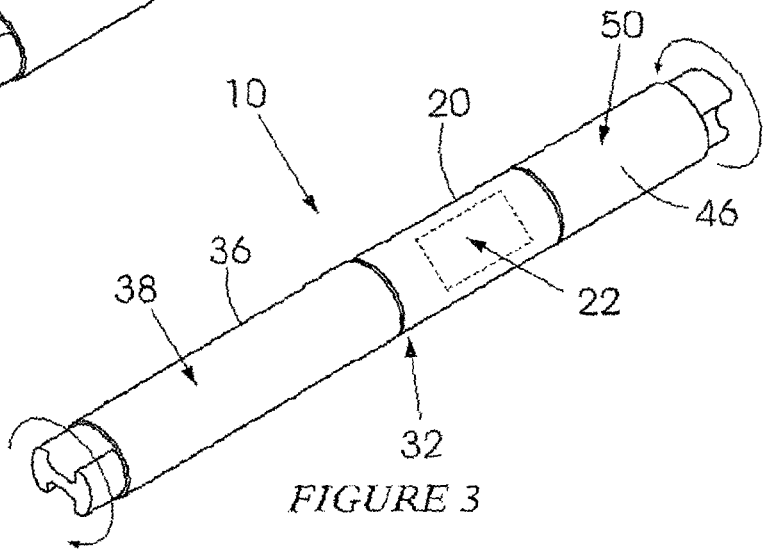

On site the assembly process of the initiating arrangement 10 follows the sequence shown in FIGS. 1, 2 and 3.

The end 16A of the initiator is configured to be inserted precisely into the recess 30 of the housing 20. An electrical connection is thereby made between terminals 96 connected to the processor 28 and operative electrical terminals 98 in the initiator 16. The second end 16B of the initiator 16 is configured to be inserted tightly into the recess 40 in the housing 36. As the recesses 30 and 40 are concentrically located, they oppose each other, and the first housing 20 can then be engaged with the second housing 36 with a screw action as is depicted in FIG. 3.

The housing 36, at one end, includes one or more formations 100 which can be used to lower the assembled wireless initiating arrangement 10 shown in FIG. 3, suspended from a suitable cord, into a borehole (not shown) to a desired position. Prior thereto, if the switch 54 is not electrically actuable, as described hereinbefore, the switch 54 is manually operated to provide power to the arrangement 10.

In use of the initiating arrangement 10 (see FIG. 4) a wireless command signal sent from a blast controller 104, which is at a remote location relative to the arrangement 10, is received at the antenna 26 and passed to the receiver 24. Communication of this type is possible through the use of magnetic waves of a suitable amplitude and frequency which can reliably pass through a body of rock, which is not too sizeable, without undue attenuation. The processor 28 implements, in a known manner, any instruction contained in the command signal. As noted, if the switch 54 is electrically actuated a first signal which preferably is encoded would cause the switch 54 to be closed.

As is known in the art the initiating arrangement is usually first brought into synchronism with other similar initiating arrangements in a blast system. Thereafter, when a fire command is received by the receiver 24, the processor 28, after a predetermined timing interval previously programmed into the processor, transmits a fire signal 106 to the initiator 16 which causes ignition thereof. That in turn causes ignition of the explosive 38.

Power for the sequence of operations is derived from the power source 50 which energises the receiver 24 and the processor 28. Energy from the power source 50 can be stored in one or more capacitors 108 in the initiator 16 or in the processor 28 or in the initiator and in the processor. This enables a firing sequence to be executed automatically and independently of the power source 50 once a fire signal has been received by the receiver e.g. a programmed timing delay is processed and, thereafter, the detonator is ignited. This is an important feature for explosive shock waves, generated by other, previously fired, initiating arrangements could interfere with the supply of energy from the power source to the processor and to the initiator.

The modular approach of the initiating arrangement 10 carries with it the significant advantages referred to hereinbefore, namely that assembly of the arrangement 10 on site at a blast bench is readily effected as the components are easily connected to one another. These components can only be connected in the manner shown; any attempt to connect the components to one another in a different manner would be unsuccessful.

The initiating arrangement 10 allows for use to be made of a substantially standard detonator in the initiator 16. The initiator 16 and the second module 14 are kept separate from the first module 12 and the power supply 50 until such time as on-site assembly is required. This feature facilitates storage and transport requirements.

In the preceding description reference is made to a system in which the arrangement 10 is positioned in a borehole and magnetically-based signals are sent, possibly through rock, to the receiver 24.

In a different system the arrangement 10 is suspended in a borehole from conductors 110 which are connected to a top-box 112 positioned, for example, at a mouth of the borehole. The top-box 112 can communicate wirelessly with a blast controller, and via the conductors 110 with the arrangement 10, to control the blasting process.

When the modules are physically connected to one another, e.g. by means of a screw action or a bayonet fitting, electrical connections are made as contacts on the respective housings are brought together. These contacts can, for example, be spring-loaded to ensure secure electrical connections are made. Other connecting techniques can however be used as may be appropriate.

The invention claimed is:

1. A wireless detonator initiating arrangement (10) which includes a first module (12) comprising a first housing (20) which includes contacts (58) and in which is mounted a signal processing assembly (24, 28), a second module (14) comprising a second housing (36) which is engageable with the first housing (20) and which contains an explosive material (38), and an initiator (16) which is engageable with at least the first housing (20) characterised in that the initiator (16) includes a first end (16A) which is locatable in a first recess (30) in the first housing (20) and a second end (16B) which is locatable in a second recess (40) in the second housing (36), in that the wireless detonator initiator arrangement (10) further includes a third housing (46), with contacts (56), which contains a power source (50) and which is engageable with the first housing (20) whereby the contacts (56) are connected to the contacts (58) to enable the power source (50) to power the signal processing assembly (24, 28), and in that the first module (12) includes a switch (54) which is actuable manually or electrically to control the connection of the power source (50) to the signal processing assembly (24, 28).

2. A wireless detonator initiating arrangement (10) according to claim 1 wherein the initiator (16) is mounted inside a casing (52).

3. A wireless detonator initiating arrangement (10) according to claim 1 which includes a capacitor (108) in at least one of the signal processing assembly (24, 28) and the initiator (16) to enable a firing sequence to be executed independently of the power source once a fire signal has been received by the receiver (24).

* * * * *